US009288602B2

(12) United States Patent
Kim et al.

(10) Patent No.: US 9,288,602 B2
(45) Date of Patent: Mar. 15, 2016

(54) STEREO EXTENSION APPARATUS AND METHOD

(71) Applicant: GWANGJU INSTITUTE OF SCIENCE AND TECHNOLOGY, Gwangju (KR)

(72) Inventors: Hong Kook Kim, Gwangju (KR); Nam In Park, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 146 days.

(21) Appl. No.: 14/301,830

(22) Filed: Jun. 11, 2014

(65) Prior Publication Data

US 2015/0071445 A1 Mar. 12, 2015

(30) Foreign Application Priority Data

Sep. 6, 2013 (KR) ..... 10-2013-0107480

(51) Int. Cl.
*H04R 5/00* (2006.01)
*H04S 5/00* (2006.01)

(52) U.S. Cl.
CPC ..... *H04S 5/00* (2013.01)

(58) Field of Classification Search
CPC ..... H04S 5/00
USPC ..... 381/17
See application file for complete search history.

(56) References Cited

PUBLICATIONS

Nam In Park et al., Artificial Stereo Extension Based on Gaussian Mixture Model, article, May 4-7, 2013, pp. 1-5, The 134th Convention of the Audio Engineering Society.
Nam In Park et al., Artificial Stereo Extension of Speech Based on Inter-Channel Coherence, article, Advanced Science and Technology Letters (ASTL), vol. 14, pp. 168-171(2012).

*Primary Examiner* — Paul S Kim
(74) *Attorney, Agent, or Firm* — Hauptman Ham, LLP

(57) ABSTRACT

Disclosed herein are a stereo extension apparatus and method. The apparatus includes a database that stores predetermined information as a result of Gaussian mixture model (GMM) training or hidden Markov model (HMM) training; a modified discrete cosine transform (MDCT) transformer that transforms a mono signal through MDCT, a feature parameter extractor that extracts a feature parameter of the mono signal from an MDCT coefficient output from the MDCT transformer, a side signal energy estimator that estimates subband energy of a side signal with reference to information stored in the database based on the feature parameter; an energy controller that obtains the MDCT coefficient of a side signal estimated from the subband energy of the estimated side signal, an inverse MDCT transformer that obtains an estimated side signal by transforming the MDCT coefficient of the estimated side signal through inverse MDCT.

6 Claims, 3 Drawing Sheets

STEREO EXTENSION APPARATUS AND METHOD

CROSS-REFERENCE TO RELATED APPLICATION

This application claims priority to Korean Patent Application No. 10-2013-0107480 filed on 6 Sep., 2013, and all the benefits accruing therefrom under 35 U.S.C. §119, the contents of which is incorporated by reference in its entirety.

BACKGROUND

1. Technical Field

The present invention relates to an apparatus and method for extending a sound signal from a mono sound signal into a stereo sound signal.

2. Description of the Related Art

It has been widely known that a stereo sound signal can provide greater user satisfaction than a mono signal.

A stereo signal contains more data than a mono signal and requires more complicated electronic devices than a mono signal. Thus, a mono signal is often used due to communication environments and requirements of the electronic device. Nevertheless, users prefer stereo signals and there is need for a method of obtaining a stereo signal when a mono signal is received or stored.

As a conventional method for listening to a mono signal in the form of a stereo signal, there has been proposed "Artificial stereo extension of speech based on inter-channel coherence" Advanced Science and Technology Letters (ASTL), Vol. 14, pp.168-171(2012). The proposed method employs interchannel coherence (ICC) to obtain a stereo signal from a mono signal.

However, the conventional method has a problem in that an obtained stereo signal is different from a real signal due to variation of ICC of the real signal. Therefore, it is difficult to satisfy listeners.

BRIEF SUMMARY

The present invention has been conceived to solve such problems in the art and it is an aspect of the present invention to provide a stereo extension apparatus and method, which can improve user satisfaction through provision of more realistic sound.

In accordance with one aspect of the present invention, a stereo extension apparatus includes a database that stores predetermined information as a result of Gaussian mixture model (GMM) training or hidden Markov model (HMM) training; a modified discrete cosine transform (MDCT) transformer that transforms a mono signal through MDCT; a feature parameter extractor that extracts a feature parameter of the mono signal from an MDCT coefficient output from the MDCT transformer; a side signal energy estimator that estimates subband energy of a side signal with reference to information stored in the database based on the feature parameter; an energy controller that obtains the MDCT coefficient of a side signal estimated from the subband energy of the estimated side signal; an inverse MDCT transformer that obtains an estimated side signal by transforming the MDCT coefficient of the estimated side signal through inverse MDCT; and a stereo signal generator that obtains a stereo signal based on sum and difference between the mono signal and the estimated side signal.

The stereo extension apparatus may further include a normalizer that normalizes the MDCT coefficient of the mono signal output from the MDCT transformer and outputs the normalized MDCT coefficient to the energy controller. Here, the feature parameter may include a subband energy vector of the mono signal.

In accordance with another aspect of the present invention, an stereo extension method includes: regarding a mono signal as a mid signal; estimating a side signal with reference to information about Gaussian mixture model (GMM) training or hidden Markov model (HMM) training stored in a database based on a feature parameter of the mono signal; and obtaining a stereo signal based on sum and difference between the mono signal and the side signal.

Estimation of the side signal may include obtaining a subband energy vector of the mid signal as a feature parameter using an MDCT coefficient extracted by transforming the mono signal through MDCT; estimating subband energy of the side signal; estimating the MDCT coefficient of the side signal using the estimated subband energy; and estimating the side signal by transforming the MDCT coefficient of the estimated side signal through inverse MDCT. Here, a normalized MDCT coefficient obtained by normalizing the MDCT coefficient of the mono signal may be used to estimate the MDCT coefficient of the side signal.

According to the present invention, the stereo extension apparatus and method can provide a stereo signal, which is similar to a real stereo signal and has improved sound quality, from a mono signal.

BRIEF DESCRIPTION OF THE DRAWINGS

The above and other aspects, features, and advantages of the present invention will become apparent from the detailed description of the following embodiments in conjunction with the accompanying drawings, in which.

DETAILED DESCRIPTION

Figure 1:
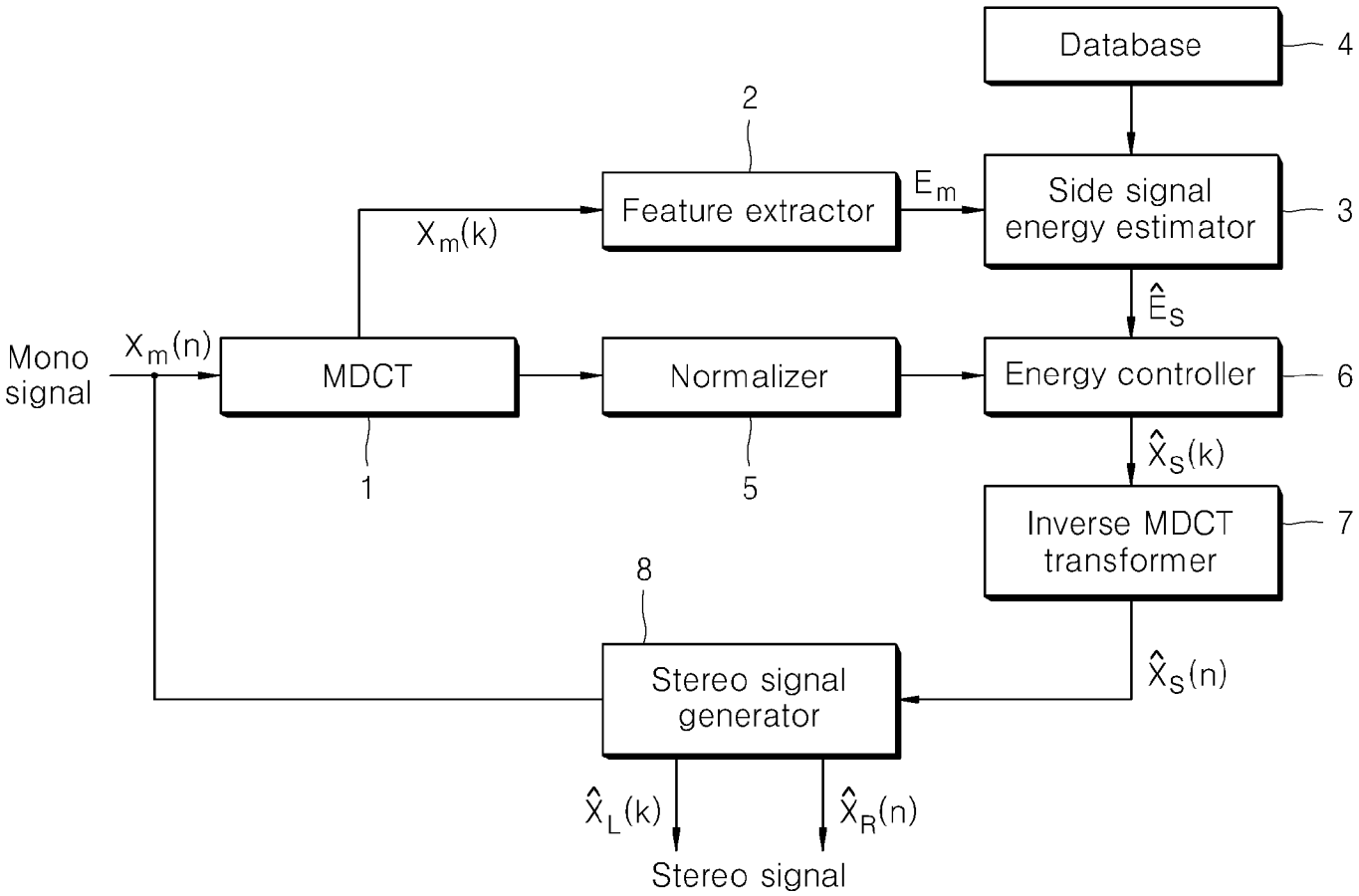
FIG. 1 is a block diagram of a stereo extension apparatus in accordance with one embodiment of the present invention.

Hereinafter, embodiments of the invention will be described in detail with reference to the accompanying drawings. It should be understood that the present invention is not limited to the following embodiments and may be embodied in different ways, and that the embodiments are given to provide complete disclosure of the invention and to provide thorough understanding of the invention to those skilled in the art. The scope of the invention is limited only by the accompanying claims and equivalents thereof. Like components will be denoted by like reference numerals throughout the specification.

<Stereo Extension Apparatus>

FIG. 1 is a block diagram of a stereo extension apparatus in accordance with one embodiment of the present invention.

Referring to FIG. 1, the stereo extension apparatus according to this embodiment includes a modified discrete cosine transform (MDCT) transformer which transforms an input mono signal into an MDCT domain as a mid signal, a feature extractor 2 which extracts a subband energy vector of the mid signal as a feature parameter, a database 4 which stores information provided as a result of Gaussian mixture model (GMM) training or hidden Markov model (HMM) training using reference audio material, and a side signal energy estimator 3 which estimates subband energy of a side signal with reference to the information stored in the database 4 based on the subband energy vector of the mid signal provided from the feature extractor 2.

In addition, the stereo extension apparatus according to this embodiment includes a normalizer 5 which normalizes an MDCT coefficient extracted from the MDCT transformer 1, and an energy controller 6 which obtains an estimated MDCT coefficient of the side signal using the normalized MDCT coefficient output from the normalizer 5 and the subband energy of the estimated side signal output from the side signal energy estimator 3.

Further, the stereo extension apparatus according to this embodiment includes an inverse MDCT transformer 7 which obtains the estimated side signal by transforming the MDCT coefficient of the estimated side signal through inverse MDCT, and a stereo signal generator 8 which obtains left and right stereo signals through sum and difference between the mono signal and the side signal.

Hereinafter, the configuration and operation of the stereo extension apparatus in accordance with the embodiment of the present invention will be described in more detail.

First, GMM training or HMM training will be described as a process of generating information to be stored in the database 4.

As training data for performing the GMM training or HMM training, 50 standard audio data may be prepared. The standard audio data may be obtained from sound quality assessment material (SQAM). Here, the standard audio data is stored at a sampling rate of 44.1 kHz, and thus a downsampling process from 44.1 kHz to 32 kHz may be additionally performed.

The training data may include a left signal $x_L(n)$ and a right signal $x_R(n)$ as the stereo signals. Then, the mid signal $x_m(n)$, the side signal $x_s(n)$, the left signal $x_L(n)$ and the right signal $x_R(n)$ are correlated as in Expression 1.

$$x_m(n)=(x_L(n)+x_R(n))/2,$$

$$x_s(n)=(x_L(n)-x_R(n))/2 \qquad \text{<Expression 1>}$$

The mid signal $x_m(n)$ and the side signal $x_s(n)$ may be transformed into the MDCT domain. Further, the subband energy can be expressed by Expression 2.

$$E_m(b)=\sqrt{\sum_{k=40b}^{40(b+2)} X_m^2(k)} \qquad \text{⟨Expression 2⟩}$$

and $$E_s(b)=\sqrt{\sum_{k=40b}^{40(b+2)} X_s^2(k)}$$

In Expression 2, b has a value ranging from 0 to 14, $X_m(k)$ and $X_s(k)$ are the MDCT coefficients of the $k^{th}$ frequency bands of the mid signal $x_m(n)$ and the side signal $x_s(n)$. Therefore, $E_m(b)$ is the subband energy of the mid signal and Es(b) is the subband energy of the side signal. In this embodiment, the number of subbands is 15, but the present invention is not limited thereto.

The subband energy of each frame may be given as a feature parameter in GMM training or HMM training. Let $E_m=[E_m(0), E_m(1), \ldots E_m(14)]$ be a spectrum subband energy vector of the mid signal and $E_s=[E_s(0), E_s(1), \ldots E_s(14)]$ be a spectrum subband energy vector of the side signal. Further, two subband energy vectors are connected to each other and expressed by $E=[E_m, E_s]$.

The subband energy vectors of the mid signal and the side signal as the parameters for GMM training or HMM training may be trained by an expectation-maximization (EM) algorithm.

Each piece of information provided through the foregoing procedure may be stored in the database 4.

Now, the configuration and operation of the stereo extension apparatus will be described.

Referring to FIG. 1 again, the MDCT transformer 1 transforms the input mono signal into the MDCT domain. In the MDCT transformer 1, it is possible to transform the mono signal $x_m(n)$ having a frame size of 640 into a frequency domain using the MDCT having 1280 points. The MDCT coefficients $X_m(k)$ of the mono signal may be grouped into 15 subbands. Here, each subband may include 80 MDCT coefficients.

As in Expression 2, the $b^{th}$ subband energy $E_m(b)$ may be extracted from the MDCT coefficient $X_m(k)$ of the mono signal. The normalizer 5 that normalizes the MDCT coefficient $X_m(k)$ of the mono signal through the $b^{th}$ subband energy $E_m(b)$ is provided. In the normalizer, normalization is performed by a method of Expression 3. Alternatively, normalization based on another method may be utilized.

$$\overline{X}_m(k)=\begin{cases}\dfrac{X_m(k)}{E_m(b)}, & 0\le k<40\\ \dfrac{X_m(k)w(k-40(b-1))}{E_m(b-1)}+\dfrac{X_m(k)w(k-40b)}{E_m(b)}, & 40\le k<600\\ \dfrac{X_m(k)}{E_m(b-1)}, & 600\le k<640\end{cases} \qquad \text{⟨Expression 3⟩}$$

Where, $b=\lfloor k/40 \rfloor$, $\overline{X}_m(k)$ is the normalized MDCT coefficient of the mono signal and w(l) is a cosine window that has a lengh of 80.

The normalized MDCT coefficient $\overline{X}_m(k)$ of the mono signal may be used as an estimated value of the side signal.

The $b^{th}$ subband energy $\hat{E}_s(b)$ of the estimated side signal may be estimated by the subband energy vector ($E_m$) of the mid signal. Here, the subband energy vector may be extracted by the feature extractor 2.

In the side signal energy estimator 3, the $b^{th}$ subband energy $\hat{E}_s(b)$ of the estimated side signal may be obtained by a minimum mean squared error (MMSE) method based on GMM training or HMM training.

In the energy controller 6, the estimated MDCT coefficient $\hat{X}_s(k)$ of the side signal may be obtained using the normalized MDCT coefficient $\overline{X}_m(k)$ of the mono signal and the subband energy $\hat{E}_s(b)$ of the estimated side signal. Specifically, the estimated MDCT coefficient $\hat{X}_s(k)$ is obtained by Expression 4.

$$\hat{X}_s(k)=\begin{cases}\overline{X}_m(k)\hat{E}_s(b), & 0\le k<40\\ \overline{X}_m(k)\hat{E}_s(b-1)w(k-40(b-1))+\overline{X}_m(k)\hat{E}_s(b)w(k-40b), & 40\le k<600\\ \overline{X}_m(k)\hat{E}_s(b-1), & 600\le k<640\end{cases} \qquad \text{⟨Expression 4⟩}$$

Next, in the inverse MDCT transformer 7, the estimated side signal $\hat{x}_s(n)$ is obtained by transforming the estimated MDCT coefficient $\hat{X}_s(k)$ of the side signal through the inverse MDCT having 1280 points.

Last, the stereo signal generator 8 obtains a stereo signal based on sum and difference between the mono signal and the side signal. Specifically, the estimated stereo signal may be generated using the following Expression 5. It can be easily understood that the mono signal is regarded as the mid signal.

$$\hat{x}_L(n)=x_m(n)+\hat{x}_s(n),$$

$$\hat{x}_R(n)=x_m(n)-\hat{x}_s(n). \quad \text{<Expression 5>}$$

Here, $\hat{x}_L(n)$ is the left signal of the estimated stereo signal and $\hat{x}_R(n)$ is the right signal of the estimated stereo signal.

As described above, the input mono signal is regarded as the mid signal and the side signal is generated based on the mono signal, thereby providing the left signal and the right signal that constitute the stereo signal.

<Stereo Extension Method>

A stereo extension method according to this embodiment may employ the stereo extension apparatus or other devices. However, it will be easily anticipated by those skilled in the art that the stereo extension apparatus is advantageously applied to the stereo extension method.

Figure 2:
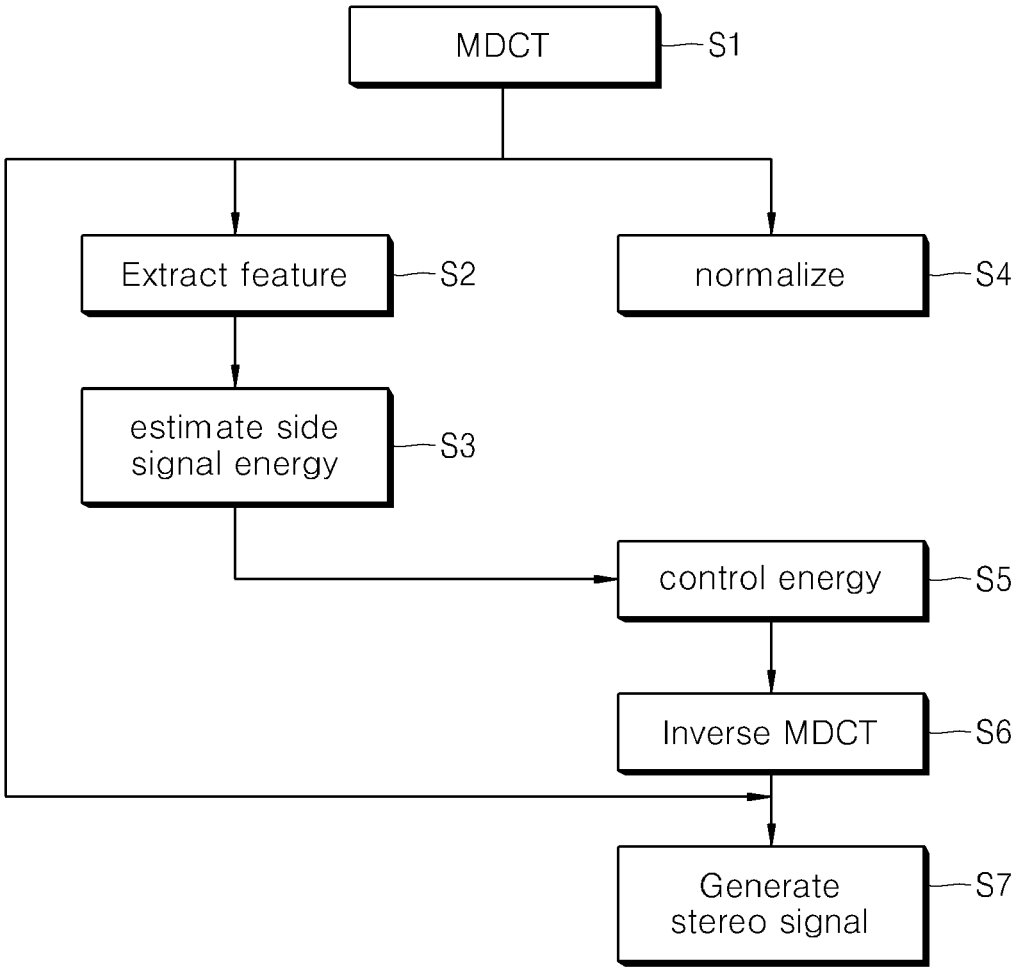
FIG. 2 is a flowchart of a stereo extension method in accordance with one embodiment of the present invention.

FIG. 2 is a flowchart of a stereo extension method in accordance with one embodiment of the present invention.

Referring to FIG. 2, first, an input mono signal is transformed as a mid signal through the MDCT (S1).

Then, a subband energy vector of the mid signal is extracted as a feature parameter using a MDCT coefficient extracted in the transformation step using the MDCT (S2), and subband energy of a side signal is estimated with reference to information stored in the database based on the extracted feature parameter (S3).

In addition, the MDCT coefficient extracted in the MDCT transformer 1 is normalized (S4), and the estimated MDCT coefficient of the side signal is obtained using the normalized MDCT coefficient and the estimated side signal of the subband energy (S5). Then, the estimated MDCT coefficient of the side signal is transformed by the inverse MDCT so as to obtain the estimated side signal (S6), and the left and right stereo signals are generated through the sum and difference between the mono signal and the estimated side signal (S7).

With the foregoing method, a mono signal is extended into a stereo signal.

<Evaluation>

To evaluate the embodiments, a multiple stimuli with hidden reference and anchor (MUSHRA) test was performed. Six audio files were taken from sound quality assessment material (SQAM) data. Each audio file was down-sampled from 44.1 kHz to 32 kHz. From the average between a left signal and a right signal, a mono signal was acquired. Two anchors having cutoff frequencies of 7 kHz and 14 kHz were prepared and compared. For the MUSHRA test, 20 test participants having normal hearing evaluated stereo quality with respect to 20 stimuli and scored the stereo quality from 0 to 100. GMM training was performed using a SQAM file except for 20 files used in the experiment.

Figure 3:
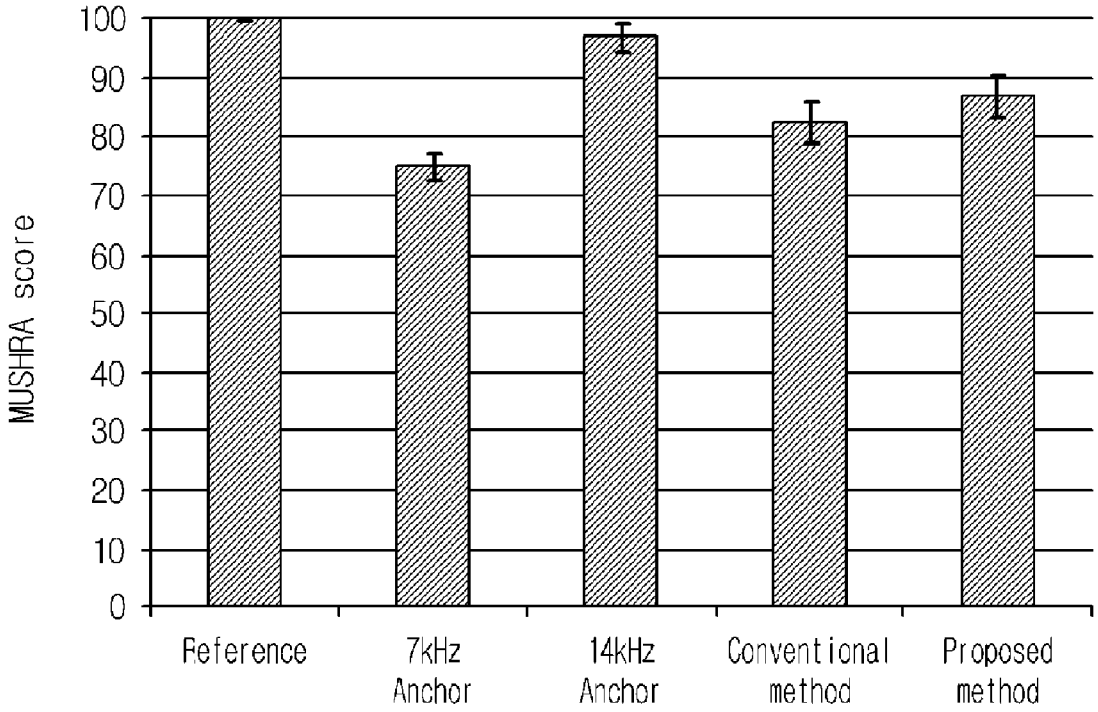
FIG. 3 is a graph showing results of a multiple stimuli with hidden reference and anchor (MUSHRA) experiment.

FIG. 3 is a graph showing results of a multiple stimuli with hidden reference and anchor (MUSHRA) experiment.

Referring to FIG. 3, each column shows an average point of seven test participants with regard to all audio files. A vertical line on the top of the column shows standard deviation of the scores. The test results showed that the method according to an exemplary embodiment gets a higher score by 5% than a conventional method using interchannel coherence (ICC).

According to the test results, it can be seen that data based on GMM training is more effective to get the stereo signal from the mono signal and further approaches an original stereo signal.

The present invention is widely applicable to a multimedia or sound system. For example, a camcorder, a digital camera, a portable multimedia player (PMP), or a cellular phone can reproduce a stereo signal based on an audio signal even though the audio signal is received in the form of a mono signal. Therefore, it is expected that the apparatus and method according to the present invention will improve user satisfaction.

Although some embodiments have been described herein, it should be understood by those skilled in the art that these embodiments are given by way of illustration only, and that various modifications, variations and alterations can be made without departing from the spirit and scope of the invention. The scope of the present invention should be defined by the following claims and equivalents thereof.

What is claimed is:

1. A stereo extension apparatus comprising:

a database that stores predetermined information as a result of Gaussian mixture model (GMM) training or hidden Markov model (HMM) training;

a modified discrete cosine transform (MDCT) transformer that transforms a mono signal through MDCT;

a feature parameter extractor that extracts a feature parameter of the mono signal from an MDCT coefficient output from the MDCT transformer;

a side signal energy estimator that estimates subband energy of a side signal with reference to information stored in the database based on the feature parameter;

an energy controller that obtains the MDCT coefficient of a side signal estimated from the subband energy of the estimated side signal;

an inverse MDCT transformer that obtains an estimated side signal by transforming the MDCT coefficient of the estimated side signal through inverse MDCT; and a stereo signal generator that obtains a stereo signal based on sum and difference between the mono signal and the estimated side signal.

2. The stereo extension apparatus according to claim 1, further comprising: a normalizer that normalizes the MDCT coefficient of the mono signal output from the MDCT transformer and outputs the normalized MDCT coefficient to the energy controller.

3. The stereo extension apparatus according to claim 1, wherein the feature parameter is a subband energy vector of the mono signal.

4. A stereo extension method comprising:

regarding a mono signal as a mid signal;

estimating a side signal with reference to information about Gaussian mixture model (GMM) training or hidden Markov model (HMM) training stored in a database based on a feature parameter of the mono signal; and obtaining a stereo signal based on sum and difference between the mono signal and the side signal.

5. The stereo extension method according to claim 4, wherein estimating the side signal comprises:

obtaining a subband energy vector of the mid signal as a feature parameter using an MDCT coefficient extracted by transforming the mono signal through MDCT;

estimating subband energy of the side signal;

estimating the MDCT coefficient of the side signal using the estimated subband energy; and estimating the side signal by transforming the MDCT coefficient of the estimated side signal through inverse MDCT.

6. The stereo extension method according to claim 5, wherein a normalized MDCT coefficient obtained by normalizing the MDCT coefficient of the mono signal is used to estimate the MDCT coefficient of the side signal.

* * * * *